US007104944B2

(12) United States Patent
Fujimaki et al.

(10) Patent No.: US 7,104,944 B2
(45) Date of Patent: Sep. 12, 2006

(54) CENTRIFUGAL SEPARATOR WITH A PLURALITY OF SHAFTS

(75) Inventors: Takahiro Fujimaki, Hitachinaka (JP); Yoshitaka Niinai, Hitachinaka (JP); Hiroyuki Takahashi, Hitachinaka (JP); Shoji Kusumoto, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 52 days.

(21) Appl. No.: 10/995,373

(22) Filed: Nov. 24, 2004

(65) Prior Publication Data

US 2005/0153823 A1 Jul. 14, 2005

(30) Foreign Application Priority Data

Nov. 25, 2003 (JP) ..... 2003-393455

(51) Int. Cl.
*B04B 13/00* (2006.01)

(52) U.S. Cl. ..... 494/10; 494/16; 494/84

(58) Field of Classification Search ..... 494/1, 494/7–10, 16, 20, 33, 43, 46, 83, 84; 210/145, 210/360.1, 380.1; 464/179, 182; 700/273
See application file for complete search history.

(56) References Cited

U.S. PATENT DOCUMENTS 5,721,676 A * 2/1998 Bolden et al. ..... 700/3
6,589,151 B1 * 7/2003 Akatsu et al. ..... 494/10
6,679,821 B1 * 1/2004 Numata et al. ..... 494/10
2004/0138041 A1 * 7/2004 Konno et al. ..... 494/84
2005/0153823 A1 * 7/2005 Fujimaki et al. ..... 494/10

FOREIGN PATENT DOCUMENTS

| | | | |
|---|---|---|---|
| GB | 2240496 A | * | 8/1991 |
| JP | 2001-104832 | * | 4/2001 |
| JP | 2005-58919 | * | 3/2005 |
| JP | 2005-111418 | * | 4/2005 |
| JP | 2005-152750 | * | 6/2005 |

* cited by examiner

*Primary Examiner*—Charles E. Cooley
(74) *Attorney, Agent, or Firm*—Antonelli, Terry, Stout and Kraus, LLP.

(57) ABSTRACT

A centrifugal separator facilitates maintenance with a function that provides the user with useful data for investigating the causes of failures and for preventing their recurrence, such as data needed to determine the appropriate management and replacement frequency of consumable parts. The centrifugal separator also has a storing unit for recording the number of times that the door is opened and closed, operation records of the drive unit by each shaft, and the number of operations performed by operating function, as well as a display unit for displaying the data. The centrifugal separator also includes a function for displaying messages prompting the user to perform maintenance when the aforementioned performance data reach a predetermined value.

15 Claims, 12 Drawing Sheets

CENTRIFUGAL SEPARATOR WITH A PLURALITY OF SHAFTS

BACKGROUND OF THE INVENTION

1. Field of the Invention

The present invention relates to a centrifugal separator and the maintenance thereof.

2. Description of Related Art

If the drive unit or rotor of a conventional centrifugal separator becomes damaged while a customer is using the centrifugal separator, such damage can have an enormous effect on the customer's business, not only due to the loss of the sample undergoing centrifugation and the cost of repair work to the centrifugal separator, but also due to the lost time while the centrifugal separator is being repaired.

Since the customer might suffer great losses when the drive unit or rotor break down or incur damage, the life of the drive unit and rotor is specified in advance. Here, the life of the drive unit denotes the estimated usage time, while the life of the rotor denotes the estimated number of uses and the usage time. Operation records of the drive unit and rotor must be maintained so that these components are not used past their estimated life. Conventionally, the user has had to meticulously record the operation records each time the centrifugal separator was used. A centrifugal separator capable of automating the management of the operation records described above is also well known in the art. Such centrifugal separators that employ a method for managing operation records and a method for managing the rotor life have been disclosed in Japanese patent No. 2671642 and Japanese patent-application publication No. 2001-104835.

SUMMARY OF THE INVENTION

When a failure occurs, centrifugal separators normally display a unique alarm that can help in identifying the cause of the failure. In addition to displaying a unique alarm when a failure occurs, some centrifugal separators possess a function for storing the control state (operational status) of the centrifugal separator in a time sequence, and a function for displaying details of the failure and the control state of the centrifugal separator during the failure in a time sequence when the repairperson performs a predetermined operation.

However, if the part that fails is a relatively minor moving part, such as a gas spring or a door hinge, the usage time and number of uses are still listed to provide a rough guideline for the frequency in which such consumable parts should be replaced. This data can be used in operation manuals or the like for recommending the periodic replacement of such parts.

With these types of centrifugal separators, either the user has had to meticulously record the operation records of the drive unit, or the centrifugal separator has means for automatically recording the operation records of the drive unit. On the other hand, some centrifugal separators are provided with a plurality of shafts that can be selected to suit the shape of the rotor. It has been sufficient to manage the operation records of the drive unit (accumulated operating time, accumulated number of rotations, and accumulated number of operations) regardless of the rotor being used for centrifugal separators with only a single shaft. However, the same management of operation records is insufficient for centrifugal separators with drive units having a plurality of shafts.

In view of the foregoing, it is an object of the present invention to provide a centrifugal separator that is easy to perform maintenance.

In order to attain the above and other objects, the present invention provides a centrifugal separator for selectively mounting and rotating a rotor among a plurality of rotors each having a kind or a size different from each other. The centrifugal separator includes a main body, a power generator, a plurality of shafts, and a storing unit. The main body has a rotor chamber that accommodates the selected rotor. The power generator is supported by the main body and has an output shaft which generates rotation torque. The plurality of shafts extends in the rotor chamber and is disposed concentrically. The storing unit stores data indicative of operation records for each of the plurality of shafts.

The centrifugal separator according to the present invention can easily provide the user or repairperson with information serving as a guideline for parts replacement and maintenance, enabling the user or repairperson to obtain accurate information regarding the usage of the centrifugal separator that is necessary for investigating the cause of a failure and preventing its recurrence. Hence, the present invention can provide a centrifugal separator that is easy to maintain.

BRIEF DESCRIPTION OF THE DRAWINGS

The above and other objects, features and advantages of the invention will become more apparent from reading the following description of the embodiments taken in connection with the accompanying drawings in which.

DETAILED DESCRIPTION OF THE PREFERRED EMBODIMENTS

A centrifugal separator according to an embodiment of the present invention will be described while referring to FIGS. 1 through 12.

Figure 1:
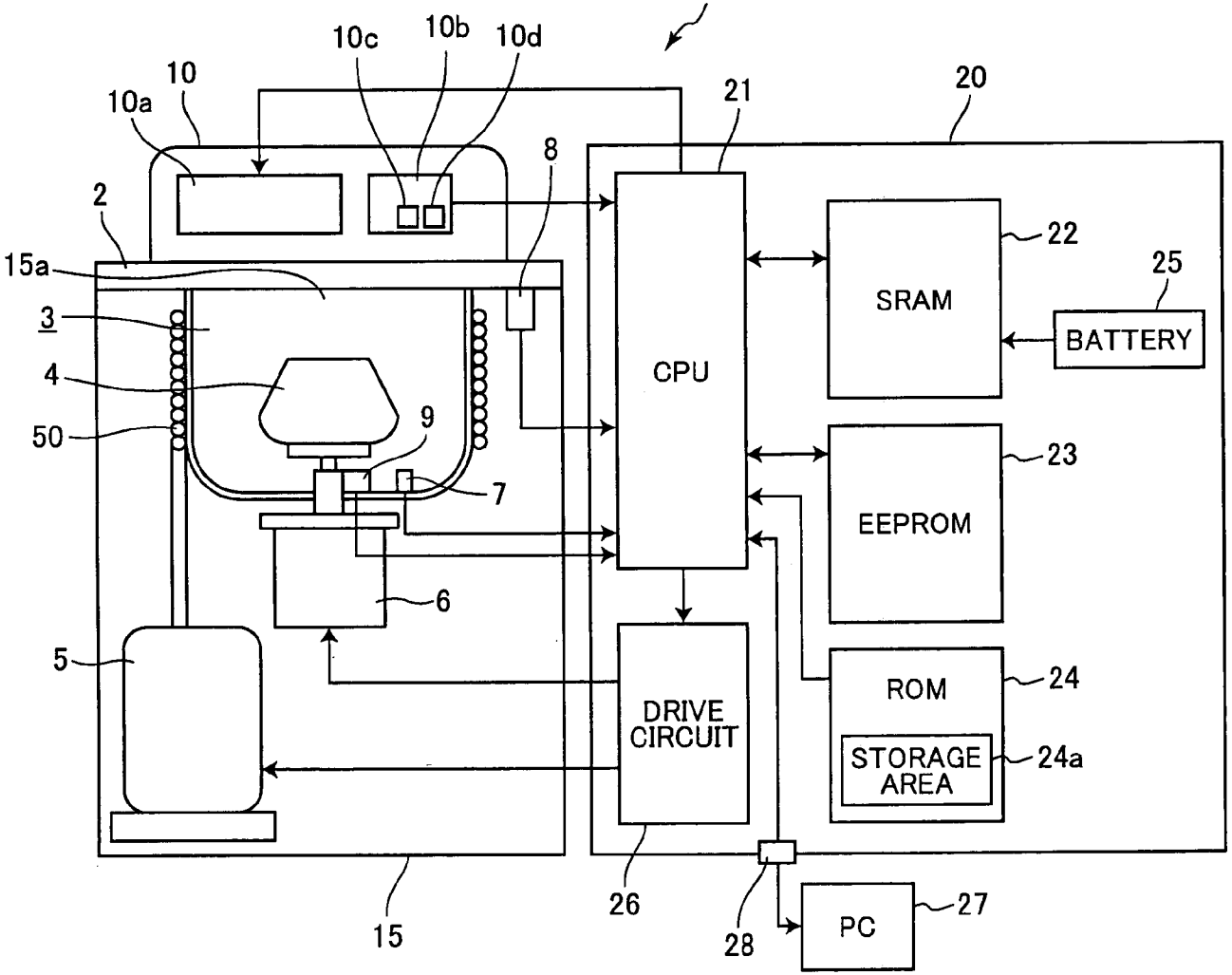
FIG. 1 is an explanatory diagram showing the structure of a centrifugal separator according to an embodiment of the present invention.

As shown in FIG. 1, a centrifugal separator 1 includes a main body (casing) 15 provided with a rotor chamber 3, a control panel 10, a door 2, a rotor 4, a cooling machine 5, a drive unit 6, a temperature sensor 7, a door switch 8, a rotor detector 9, and a control unit 20. All of the aforementioned components of the centrifugal separator 1 are accommodated within the main body 15, except the control panel 10 and the door 2. The drive unit 6 is supported by the main body 15. A personal computer 27 is connected to the centrifugal separator 1 via an external connector 28 described later. The control unit 20 is also disposed inside the main body 15, but is shown outside the main body 15 in FIG. 1 for explanatory purposes.

The control panel 10 is disposed on top of the main body 15 and includes an operating unit 10*b* for inputting operating conditions and the like, including rotational speed, operating time, and preset temperature; and a display unit 10*a* for displaying the operating conditions inputted via the operating unit 10*b* and the operating status. The operating unit 10*b* includes switches 10*c* and 10*d*. An opening 15*a* is also formed in the top portion of the main body 15. The door 2 is positioned over the opening 15*a* and is capable of opening and closing to expose the rotor chamber 3 positioned below the opening 15*a*. The drive unit 6 is disposed below the center part of the rotor chamber 3 for driving the rotor 4 to rotate. The rotor 4 selected from among a plurality of types of rotors is mounted to suit the operating conditions and the volume of samples to undergo centrifugation. For example, the plurality of types of rotors has a kind or a size different from each other. The selected rotor 4 is detachably mounted on the drive unit 6 via a crown portion 33 (FIG. 2) disposed on top of the drive unit 6. A rotor identifying portion (not shown) is provided on the bottom of the rotor. The rotor detector 9 is disposed in the bottom of the rotor chamber 3 for reading an identifier provided on the rotor identifying portion. The identifier is specific to each type of rotor. In the present embodiment, the rotor detector 9 is a magnet sensor. The identifier includes a plurality of magnets that is in a specific arrangement in a ring shape on the bottom of the rotor and thus generates a specific magnet pattern. Therefore, the rotor detector 9 can detect the specific magnet pattern and identify the selected (mounted) rotor 4. However, the rotor detector 9 and the identifier may be different type of detector and identifier other than a magnet sensor and magnets.

Refrigerant piping 50 is provided around the periphery of the rotor chamber 3 for cooling the same, while the cooling machine 5 is disposed in the bottom of the main body 15 for circulating the coolant in the refrigerant piping 50. The control unit 20 controls the drive unit 6 and the cooling machine 5 based on operating conditions inputted via the operating unit 10*b* and output signals received from the door switch 8, rotor detector 9, and temperature sensor 7, and displays various data on the display unit 10*a*. In the present embodiment, both the drive unit 6 and the cooling machine 5 are driven by a drive circuit 26, but may be driven by separate drive circuits instead.

The control unit 20 accommodates a central processing unit (CPU) 21, a static random access memory (SRAM) 22 capable of high-speed reading and writing, an electrically erasable programmable read only memory (RRPROM) 23 which is nonvolatile and has an electrical reading and writing capacity, a battery 25 for preserving data stored in the SRAM 22 when the power source to the centrifugal separator is shut off, and a read only memory (ROM) 24 for storing control programs executed by the CPU 21. A external connector 28 is also provided on the main body 15 for connecting the control unit 20 (CPU 21) with the external personal computer 27. The ROM 24 has a storage area 24*a* for storing a data set that includes various data for controlling the rotor (maximum rotational speed, temperature control data, minimum rotational radius, maximum rotational radius, selected shaft, etc.). The control unit 20 is configured so that service personnel or the like may later add new rotor control data to the RRPROM 23 that was not included when the centrifugal separator 1 was shipped.

The CPU 21 transmits signals to the drive circuit 26 according to operating conditions for the centrifugal separator 1 received from the operating unit 10*b* for controlling the drive unit 6 and the cooling machine 5 so that the rotor 4 operates at a desired rotational speed and temperature for the inputted operating time. The operating conditions include rotor number, rotational speed, operating time, control temperature, acceleration gradient, deceleration gradient, etc. As described earlier, the identifier (not shown) formed in a ring shape is disposed on the bottom of the rotor 4 for providing an identification number of the rotor 4. The control unit 20 can obtain control data suitable for a variety of rotors by extracting data from the storage area 24*a* or the RRPROM 23 that corresponds to the type of rotor detected by the rotor detector 9 while the rotor is accelerating, and temporarily storing the data in the SRAM 22. The control unit 20 also includes the external connector (external communication port) 28 that enables data communications with the personal computer 27 by connecting the personal computer 27 to the external connector 28 provided in the main body 15 with an RS232C cable. A universal serial bus (USB), local area network (LAN), or the like are other conceivable methods of communication.

Figure 2:
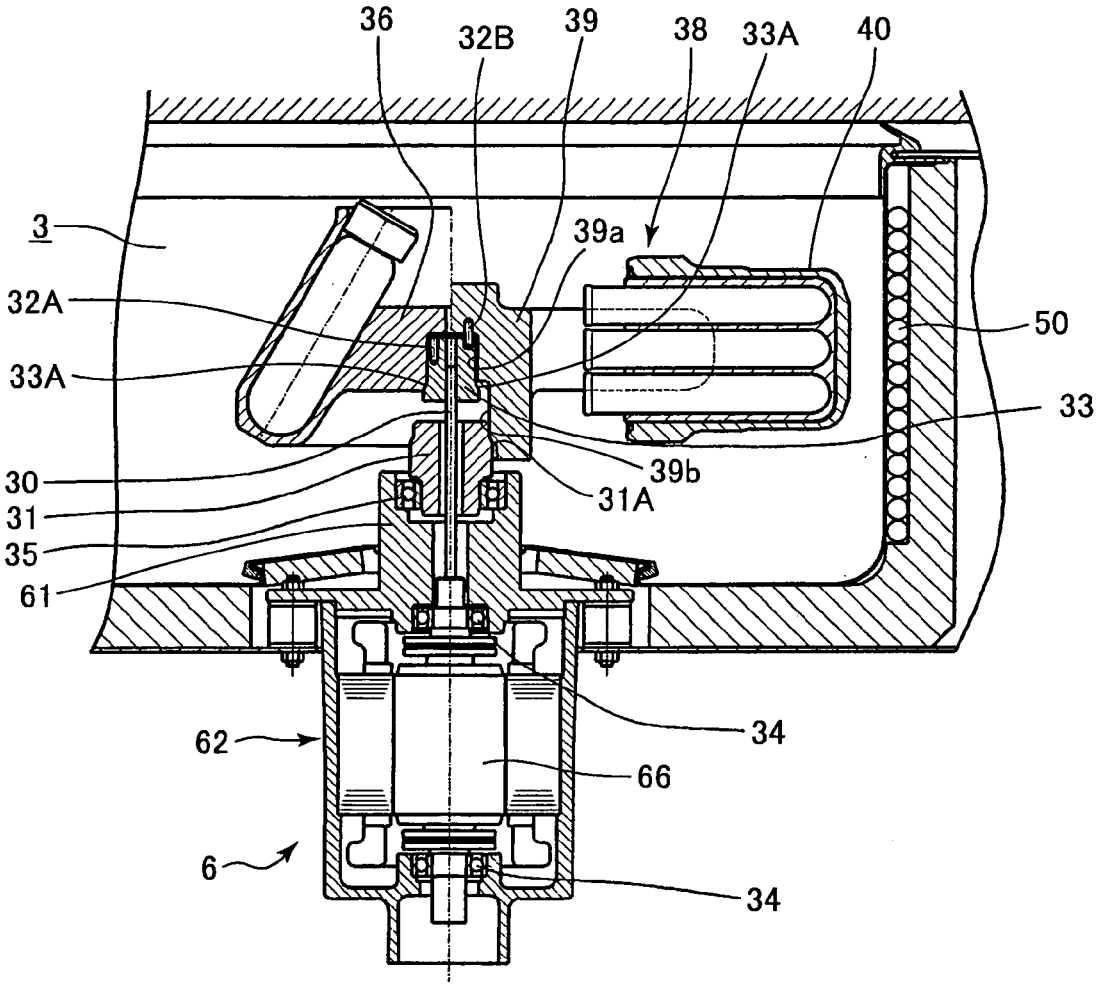
FIG. 2 is a cross-sectional view of a drive unit in the centrifugal separator according to the embodiment.

FIG. 2 is a cross-sectional vies showing the drive unit 6 for driving the selected rotor. For the convenience of description, FIG. 2 shows separate rotors in the left and right sides, when actually each rotor is symmetrical left-to-right. The drive unit 6 is provided with both an elastic shaft 30 and a high-rigidity shaft 31 that share the same axis, in other words, concentric or coaxial. The shaft to be used is dependent on the rotor selected by the user.

More specifically, the drive unit 6 includes an induction motor 62 having an output shaft 66, an end bracket 61 which also serves as a housing of the induction motor 62, the elastic shaft 30 as a rotation drive shaft, the high-rigidity rotation shaft 31 as a support shaft, and a crown portion 33. The elastic shaft means a shaft which causes elastic deformation such as flexure within operational rotation speed range, and the high-rigidity shaft means a shaft which is rigid within operational rotation speed range. The output shaft 66 is supported rotatably by bearings 34 provided in the end bracket 61 to sustain thrust loads from the output shaft 66.

The upper end side of the output shaft 66 is coaxially connected to the lower end of the elastic shaft 30, and the elastic shaft 30 extends upwards in the rotor chamber 3. The crown portion 33 is fixed to an upper end of the elastic shaft 30. The elastic shaft 30 is designed to have a primary natural frequency within a low-speed range (several ten to several hundred rpm). The crown portion 33 has an upper end implanted with a pair of pins 32A extending vertically upward to be engaged with one of rotors 36 and 38, and has a lower end formed with a tapered portion 33A.

Immediately below the crown portion 33, the high-rigidity shaft 31 is supported by a bearing 35 provided in the end bracket 61. The high-rigidity shaft 31 is rotatable about an axis concentric (coaxial) with the elastic shaft 30 and the end bracket 61. A hollow portion is formed in the center part of the high-rigidity shaft 31, in order to allow the elastic shaft 30 to be inserted loosely. A tapered portion 31A is formed at the upper portion of the shaft 31, and the lower portion thereof forms a reduced-diameter portion which is engaged with the bearing 35.

The left half of FIG. 2 shows a situation in which the angle rotor 36 is mounted. The angle rotor 36 is connected only to the crown portion 33, and is spaced away from the high-rigidity shaft 31 avoiding contact nor engagement with the high-rigidity shaft 31. A pair of pins not shown protrude downwardly from the angle rotor 36. The pair of pins are positioned on the identical imaginary circle of the pair of pins 32A of the crown portion 33. Therefore, when the angle rotor 36 is positioned above the crown portion 33 and set on the crown portion 33, the pins 32A of the crown portion 33 contact the pins of the angle rotor 36 due to rotation of the elastic shaft 30, so that the rotation torque of the elastic shaft 30 can be transmitted to the angle rotor 36.

The right half of FIG. 2 shows a situation in which the swing rotor 38 is mounted. The swing rotor 38 has radially extending arms 39, and buckets 40 are pivotally movably supported to the arms 39 through pins not shown. Note that the situation shown in FIG. 2 shows that the buckets 40 pivotally moved horizontally due to centrifugal force, performing centrifugal separation on the samples. A base portion of each arm 39 is provided with a coupling portion having a first concave portion 39*a* and a second concave portion 39*b*. The first concave portion 39*a* does not contact the top and outer peripheral portion of the crown portion 33 nor the tapered portion 33A, and a second concave portion 39*b* has a tapered portion contactable with the tapered portion 31A of the high-rigidity shaft 31. A pair of pins 32B protrude downward from the rotor 38. The swing rotor 38 and the crown portion 33 can be engaged and connected with each other only through the pins 32A and 32B. The swing rotor 38 contacts the tapered portion 31A and is mounted on the high-rigidity shaft 31. Accordingly, if the swing rotor 38 is positioned above the crown portion 33 and set on the tapered portion 31A, the pins 32A of the crown portion 33 is brought into contact with the pins 32B of the swing rotor 38 upon rotation of the elastic shaft 30, so that the rotation torque of the elastic shaft 30 can be transmitted to the swing rotor 38. Also, the mass of the swing rotor 38 cannot be received by the crown portion 33 but by the tapered portion 31A of the high-rigidity shaft 31.

In case of performing centrifugal separation using the angle rotor 36 with the structure described above, power connection can be provided only between the angle rotor 36 and the crown portion 33 by merely setting the angle rotor 36 on the crown portion 33. Therefore, the thrust load and radial load from the angle rotor 36 are received by the tapered portion 33A of the crown portion 33, so that the angle rotor 36 is rotationally driven by the elastic shaft 30.

On the other hand, in case of performing centrifugal separation using the swing rotor 38, the mass of the swing rotor 38 is supported only by the high-rigidity shaft 31, and the swing rotor 38 and the crown portion 33 are connected only by the pins 32A and pins 32B. Therefore, the thrust load and radial load from the swing rotor 38 are received by the tapered portion 31A of the high-rigidity shaft 31, and the rotation of the swing rotor 38 is supported by the bearing 35. That is, the rotation of the swing rotor 38 generated by the elastic shaft 30 is transmitted to the high-rigidity shaft 31 which supports the mass of the swing rotor 38 via the friction force of the tapered portion 31A. The high-rigidity shaft 31 then rotates relative to the end bracket 61 via the bearing 35. In other words, when the swing rotor 38 is rotated, the elastic shaft 30 merely transmits the rotation torque, so that the swing rotor 38 is supported by the high-rigidity shaft 31 and rotated together with the high-rigidity shaft 31.

As has been described above, the angle rotor 36 selects automatically the elastic shaft 30 at the time of setting. On the other hand, the swing rotor 38 can be supported automatically by the high-rigidity shaft 31 at the time of setting.

Figure 3:
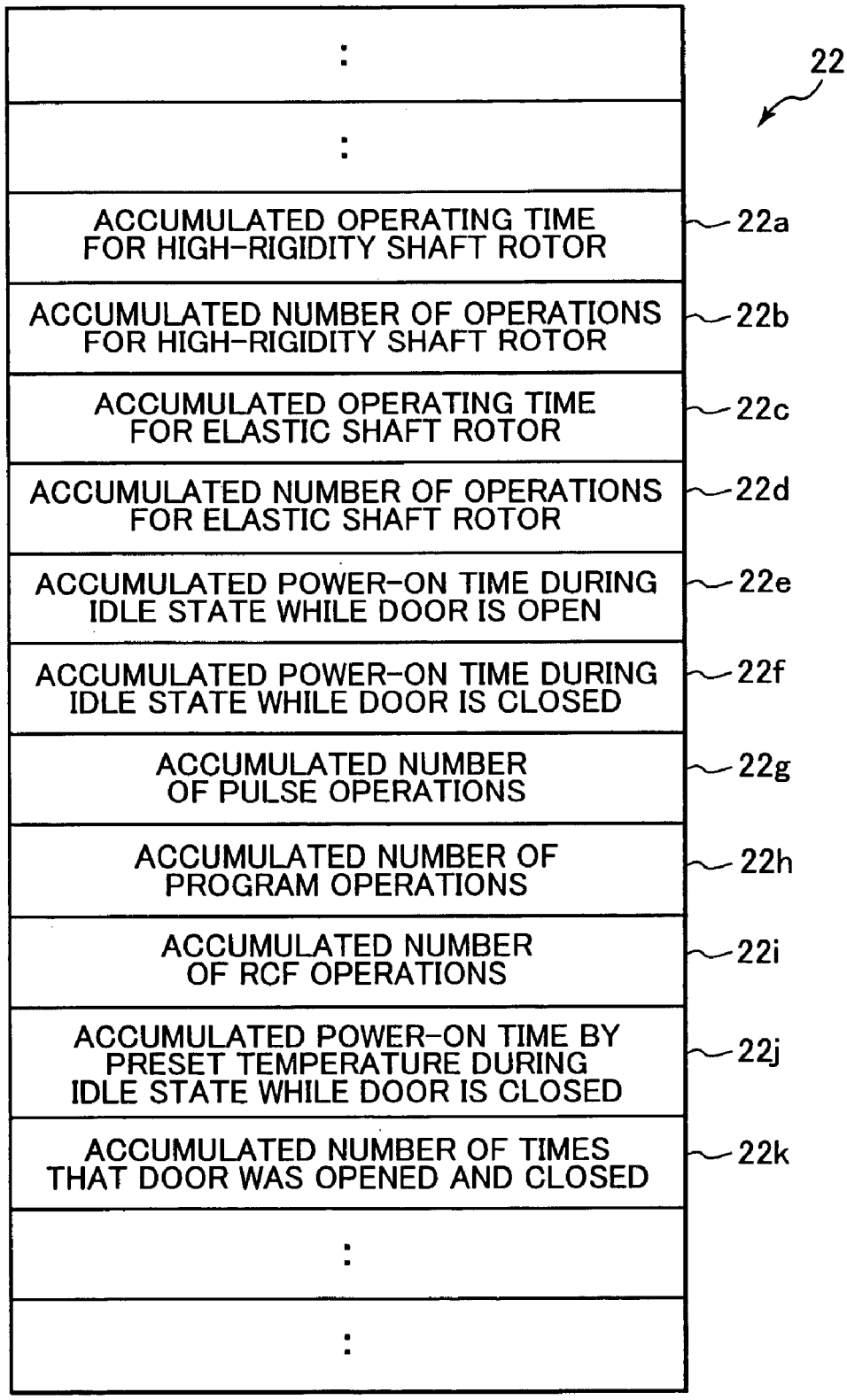
FIG. 3 is an explanatory diagram showing storage areas in SRAM provided in the centrifugal separator of the embodiment.

As shown in FIG. 3, the SRAM 22 of the control unit 20 is provided with storage areas 22*a*–22*k* for storing various data indicative of operation records. In the present embodiment, the swing rotor 38 is used as a high-rigidity shaft rotor and the angle rotor 36 is used as an elastic shaft rotor. However, this is only an example, and the angle rotor 36 may be used as a high-rigidity shaft rotor and the swing rotor 38 may be used as an elastic shaft rotor. The SRAM 22 includes storage areas for accumulated operating time for high-rigidity shaft rotor 22*a*, accumulated number of operations for high-rigidity shaft rotor 22*b*, accumulated operating time for elastic shaft rotor 22*c*, accumulated number of operations for elastic shaft rotor 22*d*, accumulated power-on time during idle state while door is open 22*e*, accumulated power-on time during idle state while door is closed 22*f*, accumulated number of pulse operations 22*g*, accumulated number of program operations 22*h*, accumulated number of RCF operations 22*i*, accumulated power-on time by preset temperature during idle state while door is closed 22*j*, accumulated number of times that door was opened and closed 22*k*, and the like. While not shown in FIG. 3, the storage area 22*j* for storing the accumulated power-on time by preset temperature when the system is idle and the door closed is further divided into smaller storage areas based on temperature.

Figure 4:
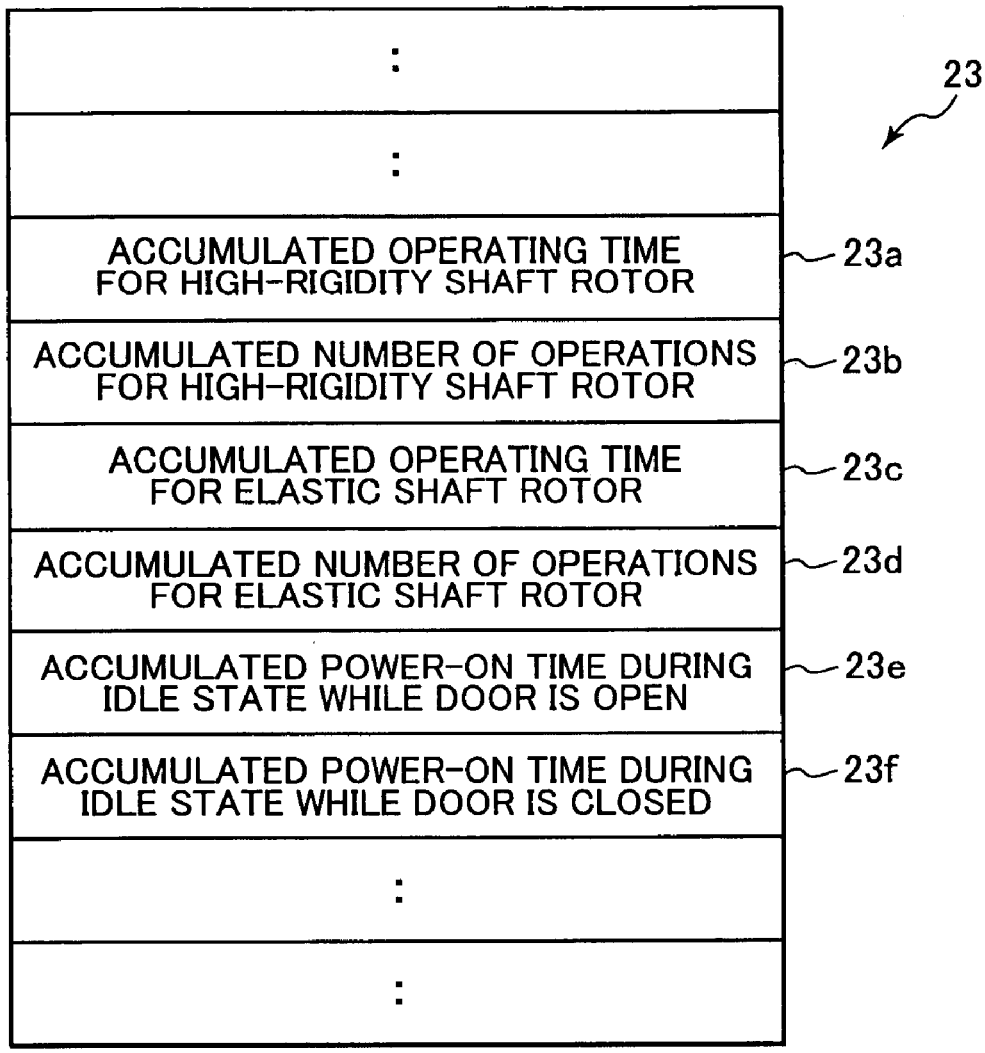
FIG. 4 is an explanatory diagram showing storage areas in EEPROM provided in the centrifugal separator of the embodiment.

FIG. 4 shows storage areas 23*a*–23*f* provided in the RRPROM 23 for storing the most important data in the SRAM 22 when the battery 25 becomes drained and can no longer maintain the data in the SRAM 22. The RRPROM 23 includes accumulated operating time for high-rigidity shaft rotor 23*a*, accumulated number of operations for high-rigidity shaft rotor 23*b*, accumulated operating time for elastic shaft rotor 23*c*, accumulated number of operations for elastic shaft rotor 23*d*, accumulated power-on time during idle state while door is open 23*e*, accumulated power-on time during idle state while door is closed 23*f*, and the like. However, the storage areas 23*a*–23*f* are merely provided to avoid the problem of losing data in the SRAM 22 due to a depleted battery 25 and are not necessarily essential.

While not requiring a battery to preserve data, the RRPROM 23 is limited in the number of times it can be reprogrammed. Hence, the RRPROM 23 cannot be frequently reprogrammed and requires a large capacity in order to copy all the data in the SRAM 22, resulting in a high cost. However, this cost can be reduced by assigning priorities to the data and storing only the most important data in the RRPROM 23, thereby reducing the required capacity of the RRPROM 23.

Figure 5:
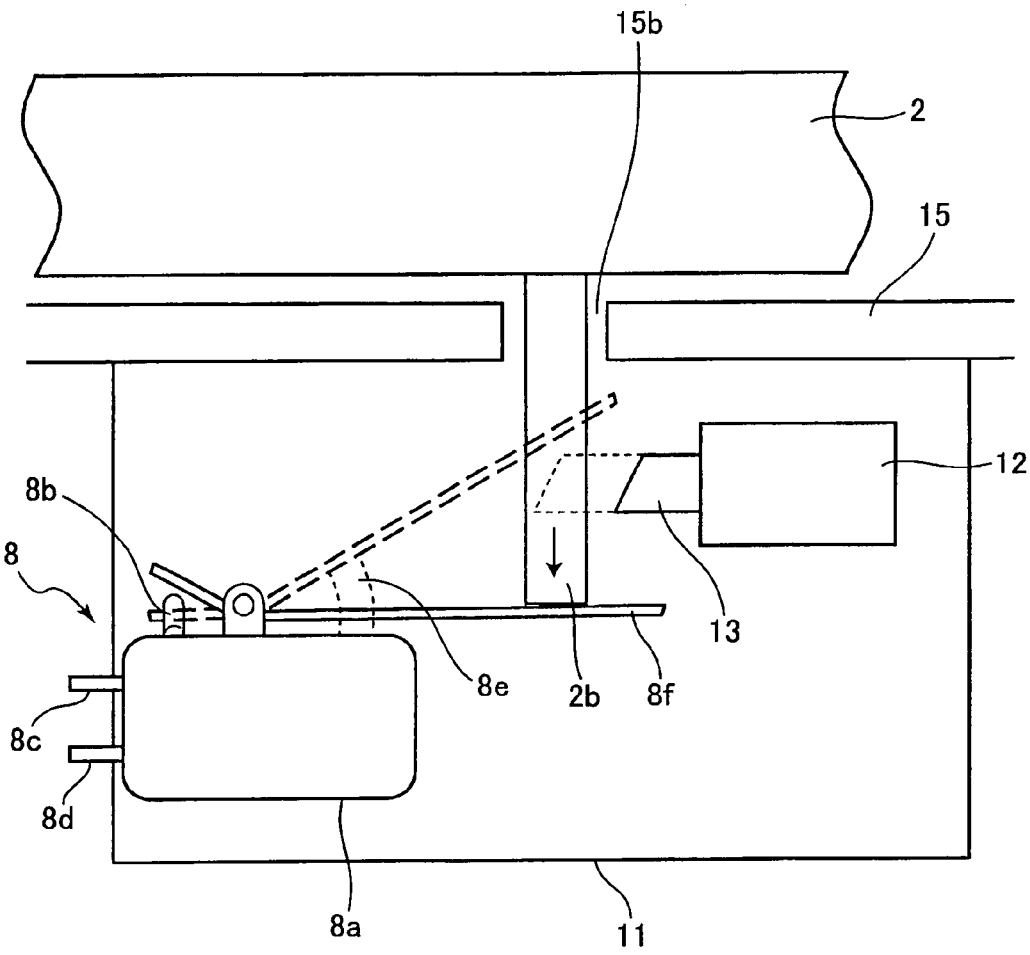
FIG. 5 is an explanatory diagram showing the construction of a door switch.

Next, a method of detecting the open and closed state of the door will be described with reference to FIG. 5. The door switch 8 is mounted on the main body 15 of the centrifugal separator 1 via a door lock holder 11. A door hook 2*b* is mounted on the inner surface of the door 2 at a position in which the door hook 2*b* can be inserted through an opening 15*b* in the main body 15.

A solenoid 12 and a lock bar 13 are provided in the door lock holder 11. The lock bar 13 is connected to the solenoid 12 and can be drawn in (a state indicated by the solid line) and pushed out (a state indicated by the dotted line) according to energizing and de-energizing of the solenoid 12. Thus, when the centrifugal separator 1 is powered on, the CPU 21 energizes the solenoid 12 to draw in the lock bar 13 (the solid line). In this state, the door 2 can be opened and closed. When the door 2 is closed, the door hook 2*b* pushes a pivotable hinge lever 8*f* down, so that the CPU 21 can detect a door close state as described later. Subsequently, when a start switch (not shown) on the operating unit 10*b* is pushed, the CPU 21 de-energizes the solenoid 12, so that the lock bar 13 is pushed out by a spring (not shown) provided in the solenoid 12 and is inserted into a hole (not shown) formed in the door hook 2*b*. In this way, the door 2 can be maintained at a locked state (the door close state).

The door switch 8 is configured of a switch unit 8*a* having the hinge lever 8*f* and a spring 8*e* that urges one end of the hinge lever 8*f* upward. As indicated by the dashed lines in FIG. 5, when the door 2 is in an open state, the spring 8*e* pushes the hinge lever 8*f* upward, while the opposite end of the hinge lever 8*f* presses against a button 8*b*. When the door 2 is closed, the door hook 2*b* presses down on the hinge lever 8*f* in the direction indicated by an arrow in FIG. 5, changing the position of the hinge lever 8*f* from that indicated by the dashed line to that indicated by a solid line in FIG. 5 and releasing the button 8*b*. The switch unit 8*a* also includes terminals 8*c* and 8*d*. Electricity is not conducted between the terminals 8*c* and 8*d* when the button 8*b* is not pushed by the hinge lever 8*f* and is conducted when the button 8*b* is pushed (the reverse is also possible), enabling the CPU 21 in the control unit 20 (FIG. 1) to detect whether the door 2 is open or closed.

Figure 6:
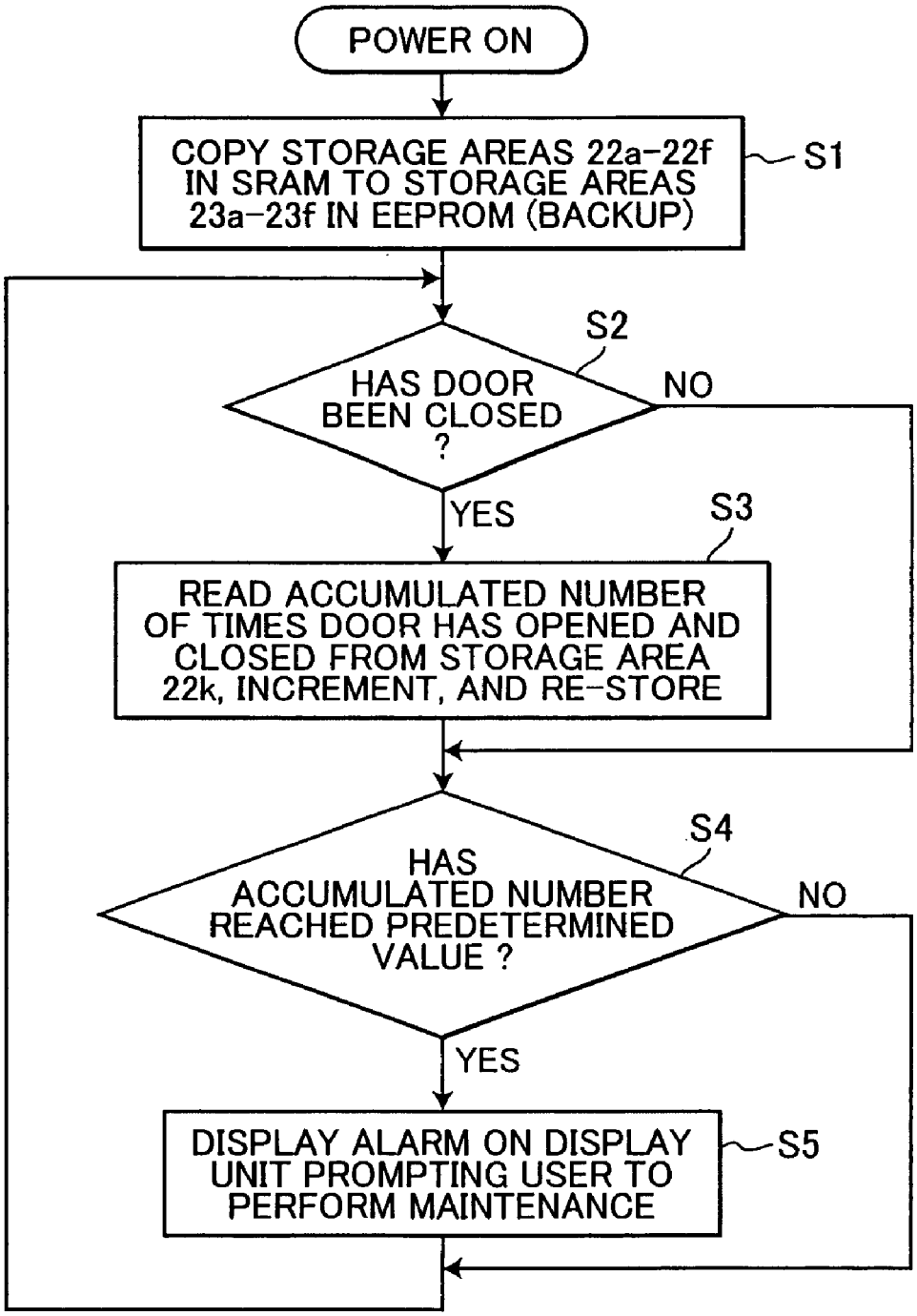
FIG. 6 is a flowchart illustrating steps in a process according to the embodiment for recording records of the accumulated number of times the door is opened and closed.

FIG. 6 is a flowchart showing steps in a process for recording the accumulated number of times that the door is opened and closed according to the present embodiment. First, a method for counting the number of times that the door is opened and closed will be described. Step is hereinafter abbreviated as "S".

When the power to the centrifugal separator 1 is turned on, in S1 the CPU 21 copies (backs up) various previously accumulated data stored in the storage areas 22*a*–22*f* of the SRAM 22 (FIG. 3) to the storage areas 23*a*–23*f* of the RRPROM 23 (FIG. 4).

In S2 the CPU 21 determines whether the door 2 has been moved to the closed position. If the door has been moved to the closed position (S2: YES), that is, the door switch 8 has been switched from the non-conducting position to the conducting position, then in S3 the CPU 21 reads the previous accumulated number of times that the door was opened and closed from the storage area 22*k* of the SRAM 22, adds 1 to this number to indicate the door was closed again, and stores the new value in the storage area 22*k*. In S4 the CPU 21 determines whether the accumulated open/close times for the door has reached a predetermined value (target life) If the accumulated open/close times have reached the predetermined value (S4: YES), then in S5 the CPU 21 displays an alarm on the display unit 10*a* and returns to S2. If the accumulated open/close times have not reached the predetermined target life (S4: NO), then the CPU 21 skips S5 and returns to S2. The process described above is repeatedly executed until the power to the centrifugal separator 1 is shut off.

More specifically, when the power to the centrifugal separator 1 is turned on in S1, the various previously accumulated data stored in the storage areas 22*a*–22*f* is copied to the storage areas 23*a*–23*f* to be saved as backup data.

When the door 2 is closed, the door switch 8 transmits a signal to the CPU 21. Upon receiving the signal, the CPU 21 determines that one open/close operation has been performed (S2: YES), reads the accumulated open/close number from the storage area 22*k*, adds 1 to this number to indicate that another open/close operation was performed, and re-stores the value in the storage area 22*k* (S3). In S4 the new value for the accumulated open/close number is compared to a predetermined value (estimated number of open/close operations in its life). If the number is the same as or greater than the predetermined value (S4: YES), then in S5 the CPU 21 displays an alarm on the display unit 10*a*, informing the user that the gas spring and other moving parts require maintenance.

Figure 7:
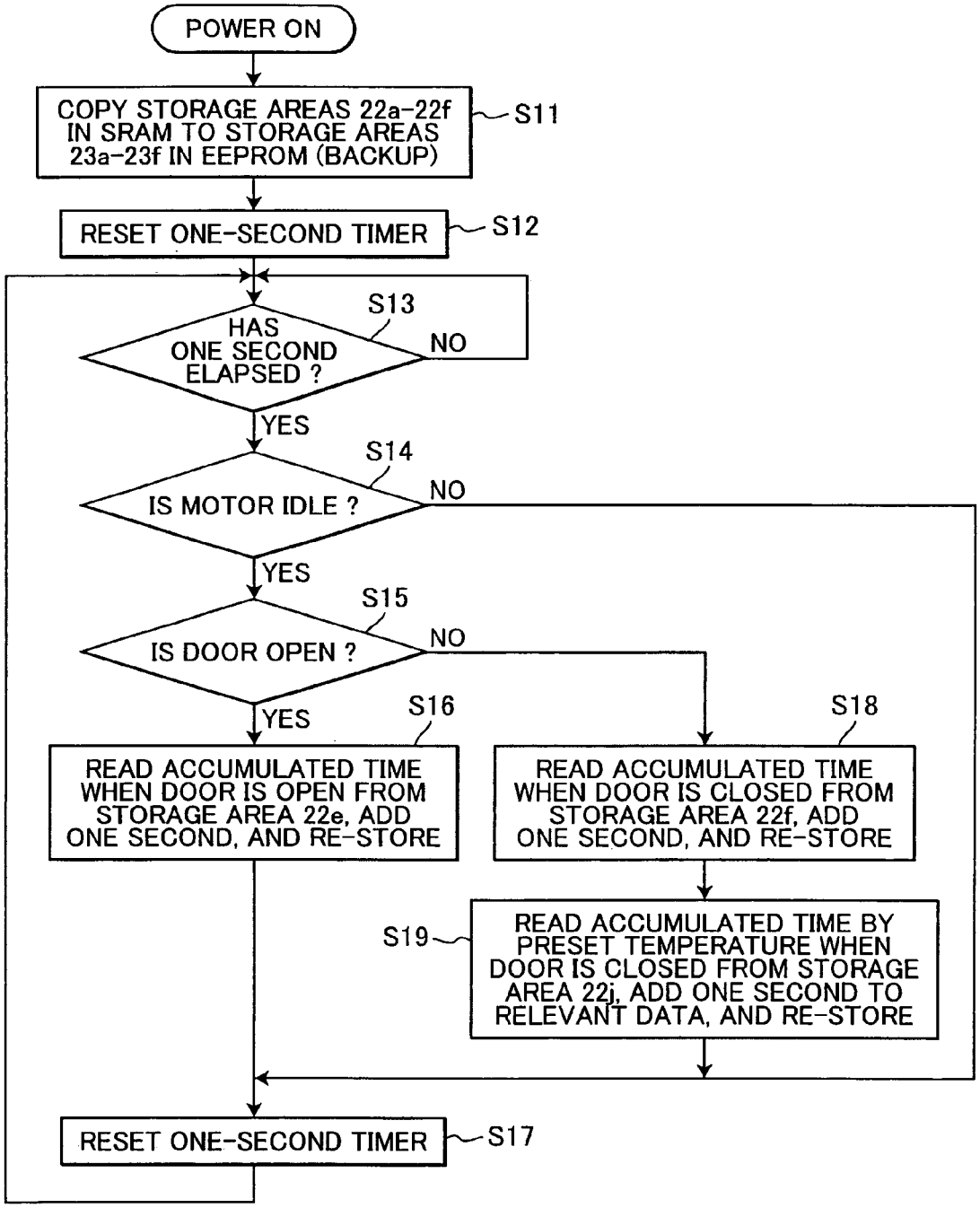
FIG. 7 is a flowchart illustrating steps in a process according to the embodiment for recording records of the accumulated time during which the door is open and during which the door is closed while the motor is idle.

FIG. 7 is a flowchart showing steps in a process according to the present embodiment for recording the accumulated time in which the door is open and closed.

When the power to the centrifugal separator 1 is turned on, in S11 the CPU 21 copies (backs up) various previously accumulated data stored in the storage areas 22*a*–22*f* to the storage areas 23*a*–23*f*. In S12 the CPU 21 resets a one-second timer. In S13 the CPU 21 determines whether one second has elapsed after the one-second timer was reset.

If the CPU 21 determines that one second has elapsed (S13: YES), then in S14 the CPU 21 determines whether the drive unit 6 is idle (halted) or operating. If the drive unit 6 is operating (S14: NO), the CPU 21 jumps to S17, resets the one-second timer, and returns to S13. However, if the drive unit 6 is idle (S14: YES), then in S15 the CPU 21 determines whether the door is open. If the door is open (S15: YES), the CPU 21 advances to S16. If the door is closed (S15: NO), the CPU 21 advances to S18. When the CPU 21 determines that the door 2 is open (S15: YES), in S16 the CPU 21 reads the accumulated power-on time during an idle state while the door is open from the storage area 22*e* of the SRAM 22, adds 1 second to this time, and re-stores the time in the storage area 22*e*. Next, in S17 the CPU 21 resets the one-second timer and returns to S13.

However, when the door 2 is closed in S15 (S15: NO), in S18 the CPU 21 reads the accumulated power-on time during an idle state when the door is closed from the storage area 22*f* of the SRAM 22, adds 1 second to this value, and stores the new value in the storage area 22*f*. In order to record the accumulated power-on time for the preset temperature inputted via the operating unit 10*b*, in S19 the CPU 21 reads the accumulated power-on time for the preset temperature during an idle state when the door is closed, from the storage area 22*j*, adds 1 second to the value, and stores the new value in the storage area 22*j*. Next, in S17 the CPU 21 resets the one-second timer and returns to S13.

More specifically, when the power to the centrifugal separator 1 is turned on, in S11 the CPU 21 copies previously accumulated data from the storage areas 22*a*–22*f* to the storage areas 23*a*–23*f* to be saved as backup data. Next, in S12 the CPU 21 resets the one-second timer and in S14 determines whether the drive unit 6 (the motor 62) is idle or operating based on whether power is being supplied from the drive circuit 26 to the drive unit 6. If the drive unit 6 is operating (power is being supplied) (S14: NO), in S17 the CPU 21 resets the one-second timer without storing the elapsed time in the storage area of the SRAM 22.

However, if the drive unit 6 is idle (power is not being supplied) (S14: YES), then the CPU 21 stores the accumulated power-on time when the door 2 is in an open state (S16) and a closed state (S18). Further, the CPU 21 records the accumulated power-on time for a preset temperature inputted via the operating unit 10*b* for the period in which the door is closed (S19). Through these operations, the condensation state in the rotor chamber 3 and the operating state of the cooling machine 5 can be known.

By repeatedly executing the process described above until the power is turned off, the centrifugal separator 1 can accurately record the open and closed status of the door when the drive unit 6 is idle. While the present embodiment describes a method for counting accumulated time using a one-second timer, any method may be used to measure time. With the process described above, it is possible to learn how much pre-cooling operation is performed by the centrifugal separator 1 having a cooling function. Here, the pre-cooling operation means operation in which the selected rotor 4 is set in the rotor chamber 3 and the rotor 4 is cooled without operating the drive unit 6. Further, by recording accumulated data by preset temperature, the user can surmise the condensation state in the rotor chamber 3 to gauge when maintenance of the drive unit 6 is necessary, facilitating maintenance of the centrifugal separator 1.

With the centrifugal separator 1 of the present embodiment, the accumulated power-on time during an idle state when the door is open and when the door is closed, the accumulated power-on time by preset temperature during an idle state when the door is closed, and the accumulated number of times the door is opened and closed stored in the storage areas 22*e*, 22*f*, 22*j*, and 22*k* can be displayed on the display unit 10*a*.

Further, by operating the switch 10*c* on the operating unit 10*b*, the user can switch the display between the accumulated power-on time during an idle state when the door is open, the accumulated power-on time during an idle state when the door is closed, the accumulated power-on time by preset temperature during an idle state when the door is closed, and the accumulated number of times the door is opened and closed. Further, data can be transmitted to and received from an external device having a storage unit or a display unit, such as the personal computer 27, that is connected via the external connector 28.

Next, a method for managing operation records of the drive unit 6 will be described. As described earlier, the angle rotor 36 (FIG. 2) is both supported and driven to rotate by the elastic shaft 30, while the swing rotor 38 is axially supported by the high-rigidity shaft 31, but driven to rotate by the elastic shaft 30. Accordingly, it is not sufficient to manage only the operation records of the drive unit 6 (accumulated operating time, accumulated number of rotations, and accumulated number of operations) without consideration for the rotor being used, as in the conventional method.

With the centrifugal separator 1 according to the present embodiment, it is possible to learn precise operation records (usage records) for the bearing 34 of the elastic shaft 30 or the bearing 35 of the high-rigidity shaft 31 by recording the operation records separately for each shaft, enabling the user to replace the bearing 34 and/or the bearing 35 according to the operation records for each shaft before damage occurs. Unlike the conventional method of managing operation records of the drive unit 6 regardless of the rotor being used, the method of the present embodiment facilitates maintenance of the drive unit 6 and extends the life of the bearings 34 and 35, unless one of the shafts 30 and 31 is used a lot more frequently or longer than the other shaft.

Next, the configuration for managing the operation records of each shaft in the drive unit 6 will be described. As described earlier, the identifier (not shown) is provided on the identifying portion on the bottom of each rotor for identifying the selected rotor. Through the detection of the rotor detector 9, the CPU 21 detects the type of rotor (rotor identification number), reads a control data set for the determined rotor stored in the storage area 24*a* of the ROM 24 and the RRPROM 23, and determines which shaft to use for the selected rotor.

Figure 8:
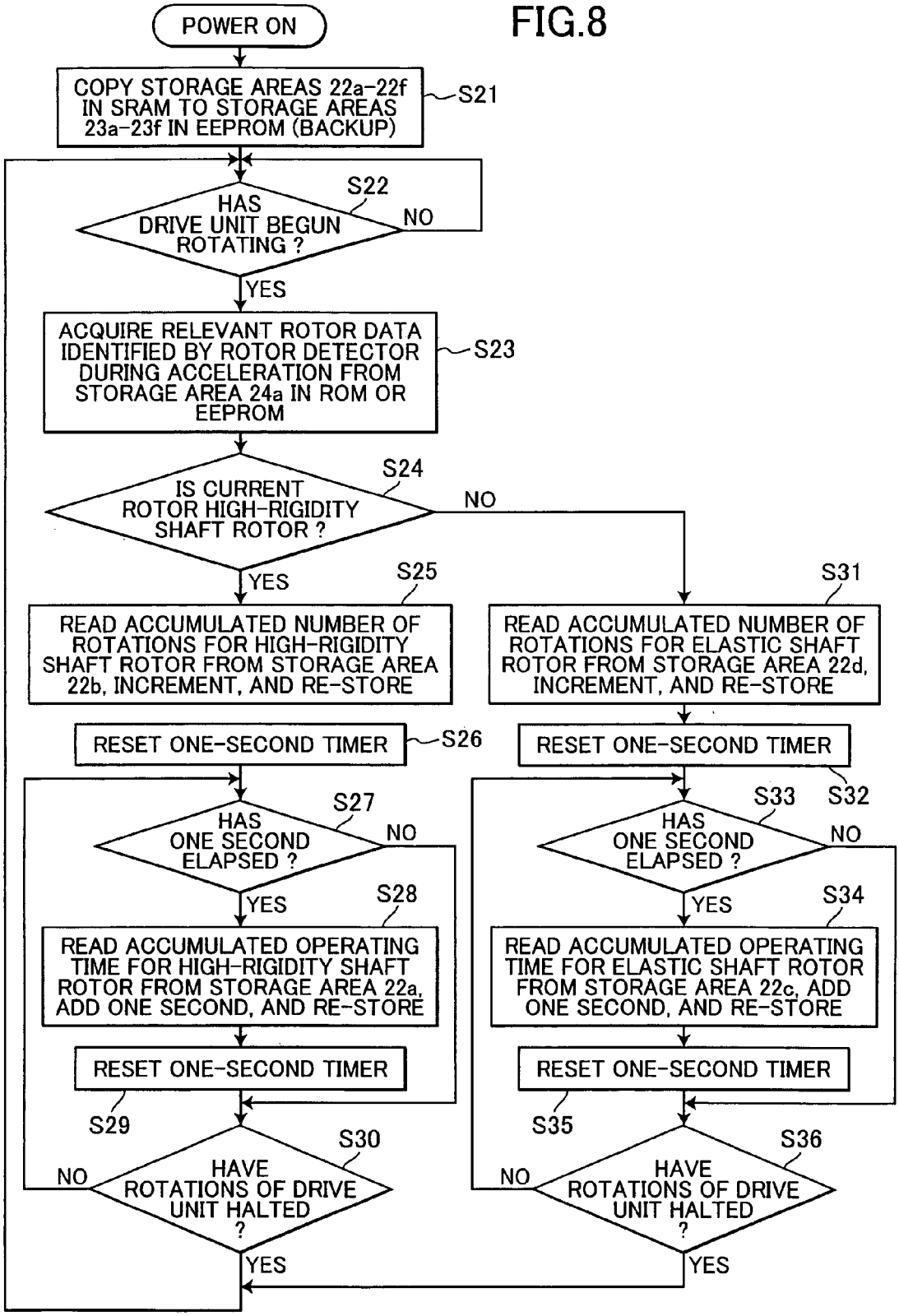
FIG. 8 is a flowchart illustrating steps in a process according to the embodiment for recording operation records by each shaft.

FIG. 8 is a flowchart showing steps in a process according to the present embodiment for recording operation records by each shaft.

When the power to the centrifugal separator 1 is turned on, in S21 the CPU 21 copies (backs up) various previously accumulated data stored in the storage areas 22*a*–22*f* to the storage areas 23*a*–23*f*. In S22 the CPU 21 waits until the drive unit 6 begins rotating.

When the drive unit 6 begins operating (S22: YES), in S23 the rotor detector 9 detects the type of rotor that is rotating, and the CPU 21 determines the rotor identification number based on the detection by the rotor detector 9 and extracts the relevant rotor data from control data sets by rotor number in the storage area 24*a* or the RRPROM 23. In S24 the CPU 21 determines which shaft the selected rotor employs. If the CPU 21 determines in S24 that the rotor employs the high-rigidity shaft 31 (S24: YES), then in S25 the CPU 21 reads the previously accumulated number of operations for the high-rigidity shaft rotor from the storage area 22*b*, adds 1 to the number, and stores the new value back in the storage area 22*b*.

In S26 the CPU 21 resets a one-second timer. In S27 the CPU 21 determines whether one second has elapsed based on the one-second timer. If one second has not elapsed (S27: NO), then in S30 the CPU 21 determines whether the drive unit 6 is idle, in other words, whether rotations of the drive unit 6 have halted, and returns to S22 if the drive unit 6 is idle (S30: YES). However, if the drive unit 6 is operating (S30: NO), then the CPU 21 returns to S27 and loops between S27 and S30 until one second has elapsed. When the CPU 21 determines in S27 that one second has elapsed (S27: YES), the CPU 21 advances to S28.

In S28 the CPU 21 reads the previously accumulated operating time for the high-rigidity shaft rotor from the storage area 22*a*, adds one second to the accumulated operating time, and stores the new value back in the storage area 22*a*. In S29 the CPU 21 resets the one-second timer. In S30 the CPU 21 again determines whether the drive unit 6 is operating and returns to S27 if the drive unit 6 is still operating (S30: NO). Hence, the accumulated operating time for the high-rigidity shaft rotor is incremented until the drive unit 6 is halted. When the drive unit 6 is stopped (S30: YES), the CPU 21 returns to S22 and continually monitors the drive unit 6 until the drive unit 6 again begins to rotate.

If the CPU 21 determines in S24 that the current rotor employs the elastic shaft 30 (S24: NO), then in S31 the CPU 21 reads the previously accumulated number of operations for the elastic shaft rotor from the storage area 22*d*, adds 1 to the value, and stores the new value back in the storage area 22*d*.

In S32 the CPU 21 resets the one-second timer. In S33 the CPU 21 determines whether one second has elapsed based on the one-second timer. If one second has not elapsed (S33:

NO), then in S36 the CPU 21 determines whether the drive unit 6 is idle, in other words, whether rotations of the drive unit 6 have halted, and returns to S22 if the drive unit 6 is idle (S36: YES). However, if the drive unit 6 is operating (S36: NO), then the CPU 21 returns to S33 and loops between S33 and S36 until one second has elapsed. When the CPU 21 determines in S33 that one second has elapsed (S33: YES), the CPU 21 advances to S34.

In S34 the CPU 21 reads the previously accumulated operating time for the elastic shaft rotor from the storage area 22*c*, adds one second to this time, and stores the new value back in the storage area 22*c*. In S35 the CPU 21 resets the one-second timer. In S36 the CPU 21 again determines whether the drive unit 6 is operating and returns to S33 if the drive unit 6 is still operating (S36: NO). Hence, the accumulated operating time for the elastic shaft rotor is incremented until the drive unit 6 is halted. When the CPU 21 determines in S36 that the drive unit 6 is idle (S36: YES), the CPU 21 returns to S22 and monitors the drive unit 6 until the drive unit 6 again begins to rotate.

More specifically, when the power to the centrifugal separator 1 is turned on, previously accumulated data stored in the storage areas 22*a*–22*f* is copied to the storage areas 23*a*–23*f* of the EEPROM 23 and saved as backup data (S21). Next, when the drive unit 6 begins rotating (S22: YES), the rotor detector 9 detects the identifier provided on the bottom of the rotor to determine the type of rotor. The CPU 21 determines the rotor identification number for the detected rotor type and extracts relevant rotor information (specifications) from control data stored for the rotor in either the storage area 24*a* or the RRPROM 23 (S23).

Since the extracted rotor information includes information for the shaft used for the currently operating rotor, the CPU 21 can determine which shaft is being used by the currently operating rotor (S24) and can increment only the accumulated number of operations for the shaft being used (S25, S31).

For example, when the current rotor employs the high-rigidity shaft (S24: YES), in S25 the CPU 21 reads data stored in the storage area 22*b* for the accumulated number of operations for the high-rigidity shaft rotor, increments the value by one, and stores the result in the storage area 22*b*. Each time one second elapses (S27: YES), in S28 the CPU 21 reads the accumulated operating time for the high-rigidity shaft rotor from the storage area 22*a*, increments the value by one second, stores the result back in the storage area 22*a*, and subsequently in S29 resets the one-second timer. Accordingly, the accumulated operating time in units of seconds can be stored for each shaft. Similarly, when the elastic shaft rotor is used (S24: NO), the CPU 21 increments the accumulated number of operations for the elastic shaft rotor in the storage area 22*d* (S31) and the accumulated operating time for the elastic shaft rotor in the storage area 22*c* (S34).

While the embodiment describes one method for counting accumulated time using a one-second timer, any method may be employed for measuring time. With this process, operation records can accurately be recorded for different shafts in a centrifugal separator having both a high-rigidity shaft and an elastic shaft, thereby facilitating maintenance.

Unlike the conventional method for determining the life span of a drive unit simply by managing the accumulated number of operations and accumulated operating time, the centrifugal separator 1 of the present embodiment can manage operation records for the high-rigidity shaft 31 and the elastic shaft 30 separately. Accordingly, it is possible to preset estimated values for the accumulated number of operations and operating time in the life for each of the bearings 34 and 35 and to display an alarm on the display unit 10*a* for each bearing when the life of the bearing has expired. Therefore, the bearings 34 and 35 can be replaced based on their individual operation records, and the drive unit 6 can be replaced before the elastic shaft incurs damage. Accordingly, the life of the drive unit 6 can be extended, unless one of the shafts is used a lot more frequently or longer than the other shaft.

In the centrifugal separator 1 according to the present embodiment, the accumulated operating time and accumulated number of operations for the high-rigidity shaft rotor and the accumulated operating time and accumulated number of operations for the elastic shaft rotor stored in the storage areas 22*a*–22*d* can be displayed on the display unit 10*a*.

The content on the display unit 10*a* can be switched between each of these types of data by operating the switch 10*c* on the operating unit 10*b*. Further, data can be exchanged between an external device having a storage unit or a display unit, such as the personal computer 27, that is connected to the control unit 20 via the external connector 28.

Figure 9:
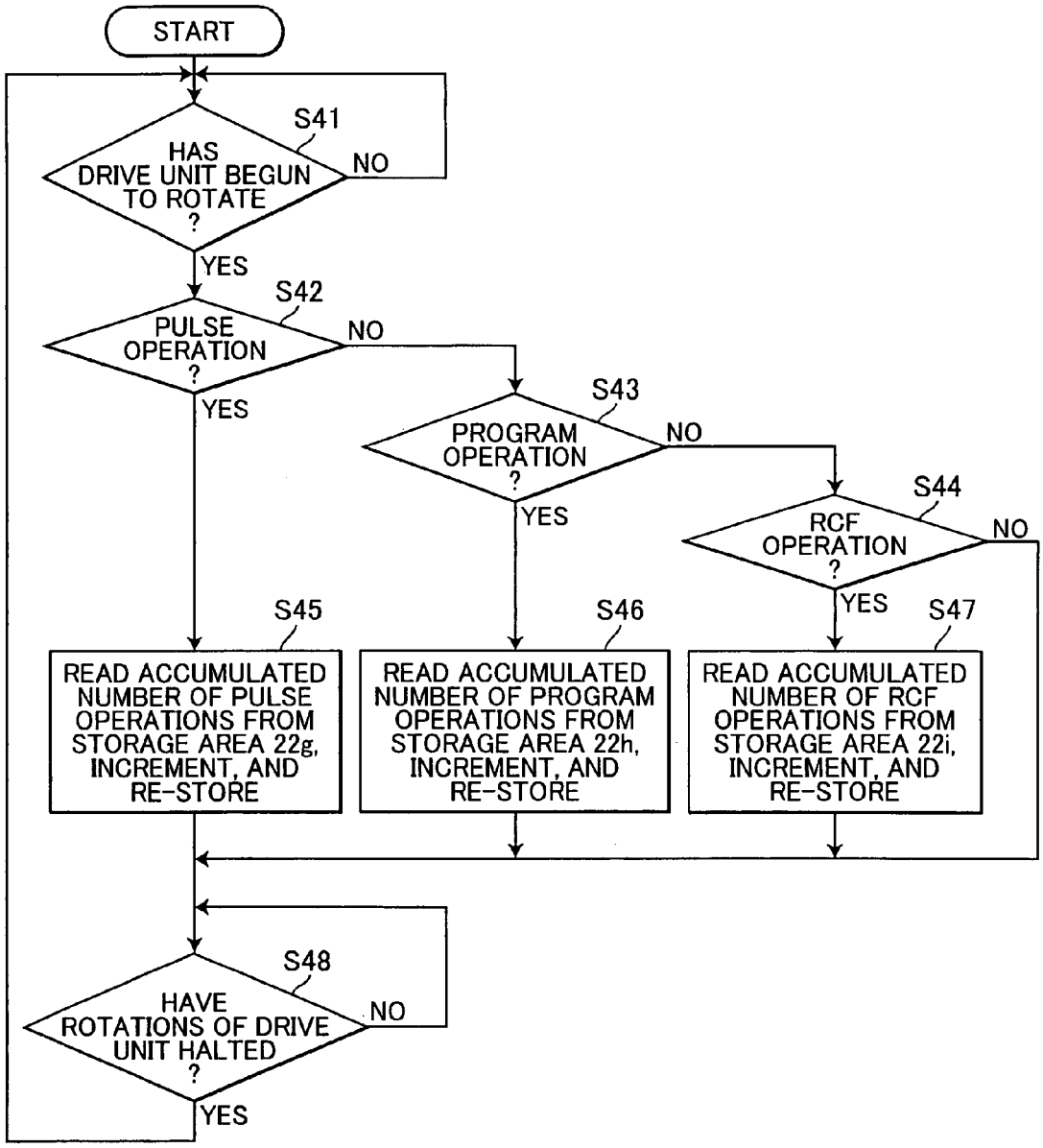
FIG. 9 is a flowchart illustrating steps in a process according to the embodiment for recording operation records by operating function.

FIG. 9 is a flowchart showing steps in a process according to the present embodiment for recording operation records by operating function.

The centrifugal separator 1 has various operating functions, such as a pulse operation in which operations continue only while a pulse switch provided on the operating unit 10*b* is pressed down; a program operation (also called a memory operation) in which operations are performed by calling operating conditions stored in memory when needed; and an RCF operation in which centrifugal acceleration is set as the operating condition of the centrifugal separator instead of the rotational speed. Data for performing these operations are stored in the control unit 20. Further, the control unit 20 controls the centrifugal separator 1 according to these various operating functions.

As shown in FIG. 9, in S41 the CPU 21 waits until the drive unit 6 begins rotating (S41: NO). Once the drive unit 6 begins rotating (S41: YES), the CPU 21 determines in S42–S44 whether the operating function is a pulse operation, a program operation, an RCF operation, or a normal operation. If the CPU 21 determines in S42 that the operating function is a pulse operation, then in S45 the CPU 21 reads the accumulated number of pulse operations from the storage area 22*g* in the SRAM 22 and increments the number of pulse operations by 1.

If the CPU 21 determines in S43 that the operating function is a program operation (S43: YES), then in S46 the CPU 21 reads the accumulated number of program operations from the storage area 22*h* in the SRAM 22 and increments the number of program operations by 1.

If the CPU 21 determines in S44 that the operating function is an RCF operation (S44: YES), then in S47 the CPU 21 reads the accumulated number of RCF operations from the storage area 22*i* in the SRAM 22 and increments the number of RCF operations by 1. If the CPU 21 determines in S42–S44 that the operating function is none of the pulse operation, program operation, or RCF operation (S42–S44: NO), then the CPU 21 determines that the operating function is a normal operation. In S48 the CPU 21 determines whether the drive unit 6 has halted. If the drive unit 6 has not halted (S48: NO), then the CPU 21 loops back to S48. When the CPU 21 determines that the drive unit 6 has halted (S48: YES), then the CPU 21 returns to S41. By incrementing the values stored in the corresponding storage areas 22g–22i as described above according to the operations, the accumulated number of operations can be recorded for each operating function.

Figure 10:
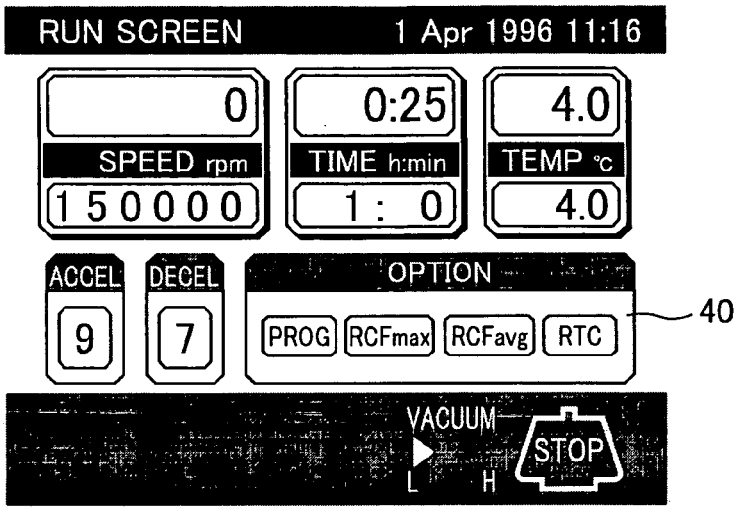
FIG.10 (PRIOR ART)
FIG. 10 is an explanatory diagram showing a sample view of the display unit in a conventional centrifugal separator.
Figure 11:
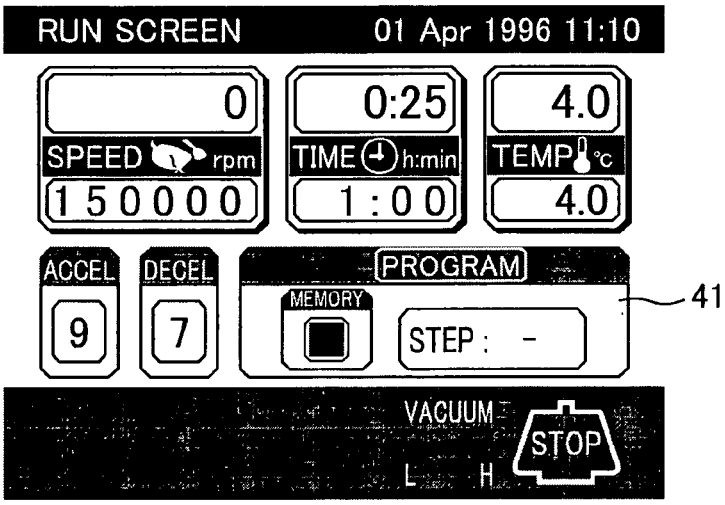
FIG. 11 is an explanatory diagram showing a sample view of the display unit in the centrifugal separator according to the embodiment.
Figure 12:
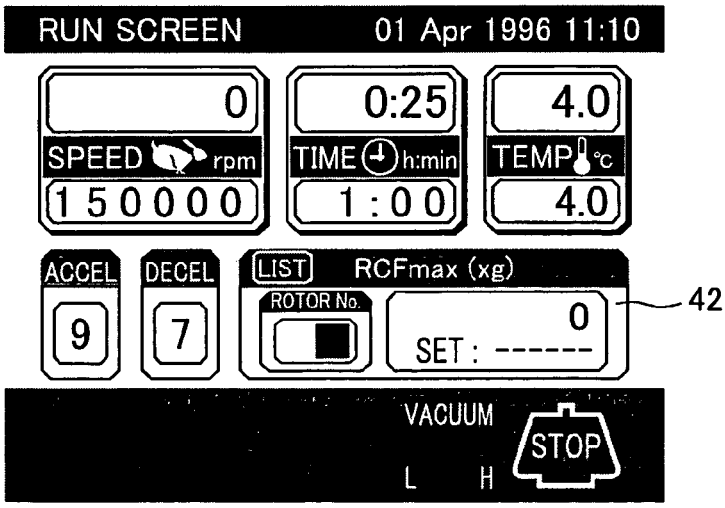
FIG. 12 is an explanatory diagram showing another sample view of the display unit in the centrifugal separator according to the embodiment.

FIG. 10 shows an example of content displayed on the display of a conventional centrifugal separator, while FIGS. 11 and 12 show examples of content displayed on the display unit 10a of the centrifugal separator 1 according to the present embodiment.

Since the centrifugal separator 1 of the present embodiment can record operation records separately for various operating functions, the user's methods and patterns of use can be known accurately. By performing maintenance according to these methods and patterns of use, it is possible to perform optimal preventative maintenance for individual centrifugal separators and to obtain accurate information regarding usage conditions of the centrifugal separators that is necessary for investigating causes of failures and for preventing their recurrence, thereby facilitating maintenance.

Further, it is possible to know the operating function most frequently used by the user, making it possible to display the most frequently used operating function on the display unit 10a first when the power to the centrifugal separator 1 is turned on, thereby further improving user-friendliness. For example, rather than displaying an operating function list 40 (FIG. 10) and having the user select from the operating function list 40 using the operating unit 10b, the control unit 20 can display an input screen based on the most frequently used function, such as a program operation input screen 41 (FIG. 11) or an RCF operation input screen 42 (FIG. 12), when the power to the centrifugal separator 1 is turned on.

In the centrifugal separator 1 according to the present embodiment, the accumulated number of pulse operations, accumulated number of program operations, and accumulated number of RCF operations stored in the storage areas 22g–22i can be displayed on the display unit 10a. Further, the user can switch the display unit 10a between these different accumulated numbers by operating the switch 10d on the operating unit 10b. Further, data can be transmitted to and received from an external device having a storage unit or a display unit, such as the personal computer 27, that is connected via the external connector 28.

Maintenance of the cooling machine 5 can also be improved by storing, in the SRAM 22, the accumulated time during which the control unit 20 drives the cooling machine 5.

While the invention has been described in detail with reference to the specific embodiment thereof, it would be apparent to those skilled in the art that various changes and modifications may be made therein without departing from the spirit of the invention.

Figure 13:
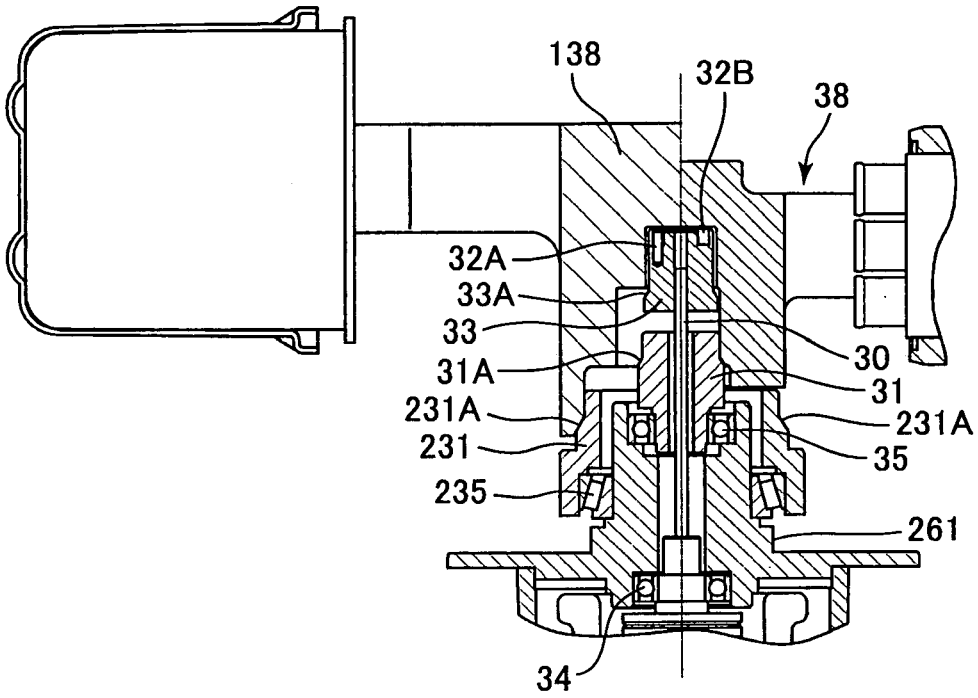
FIG. 13 is a cross-sectional view of a drive unit in a centrifugal separator according to a first modification.

A centrifugal separator according to a first modification will be described with reference to FIG. 13. The first modification enables selective setting of the above-described swing rotor 38 or a second swing rotor 138 which is larger than the swing rotor 38. Therefore, in addition to the high-rigidity shaft 31 in the above-described embodiment, a second high-rigidity shaft 231 is provided rotatably and coaxially, outside in the radial direction of the high-rigidity shaft 31. The second high-rigidity shaft 231 is rotatably supported by the end bracket 261 via the bearing 235. A tapered portion 231A capable of contacting a tapered surface of the second swing rotor 138 is formed in the outer peripheral surface of the high-rigidity shaft 231. The thrust load and the radial load from the swing rotor 138 are received by the tapered portion 231A, and the swing rotor 138 is rotatably supported by the end bracket 261 via the bearing 235 through the second high-rigidity shaft 231. The swing rotor 138 is supported by the second high-rigidity shaft 231 and rotated together with the high-rigidity shaft 231. The large swing rotor 138 is supported by the bearing 235 which has a large load resistive capacity.

Figure 14:
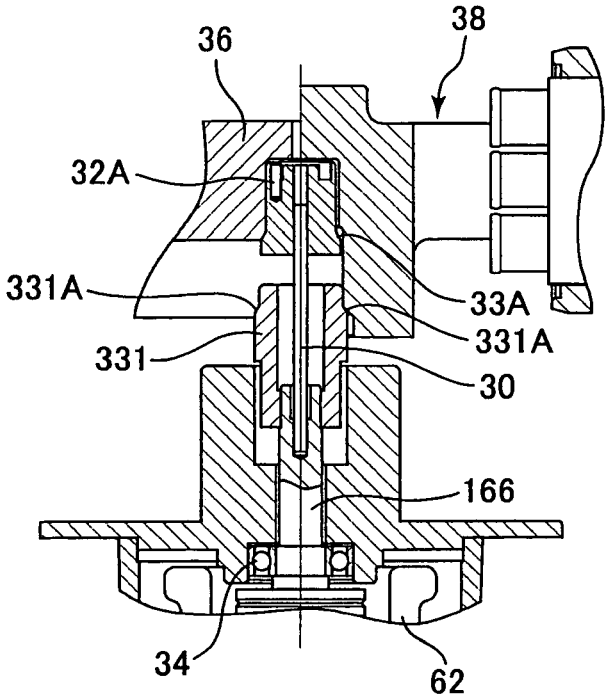
FIG. 14 is a cross-sectional view of a drive unit in a centrifugal separator according to a second modification.

A centrifugal separator according to a second modification will be described with reference to FIG. 14. In the second modification, the length of upward protrusion of the output shaft 166 of the motor 62 is increased, and an elastic rotation shaft 30 is coaxially coupled with the top end portion of the protrusion. Further, a hollow high-rigidity rotation shaft 331 is coaxially coupled with the outer circumferential surface of the top end portion of the output shaft 166. A tapered surface 331A is formed in the outer peripheral surface of the high-rigidity rotation shaft 331 for receiving the swing rotor 38. When the swing rotor 38 is set, the tapered surface of the concave portion of the swing rotor 38 contacts the tapered surface 331A of the high-rigidity rotation shaft 331. Rotation torque of the induction motor 62 is directly transmitted to the high-rigidity rotation shaft 331, so that the rotation force can be transmitted to the swing rotor 38 by the friction force of the tapered surface 331A. Accordingly, in the second modification, the high-rigidity rotation shaft 331 serves as drive shaft when the swing rotor 38 is mounted.

Figure 15:
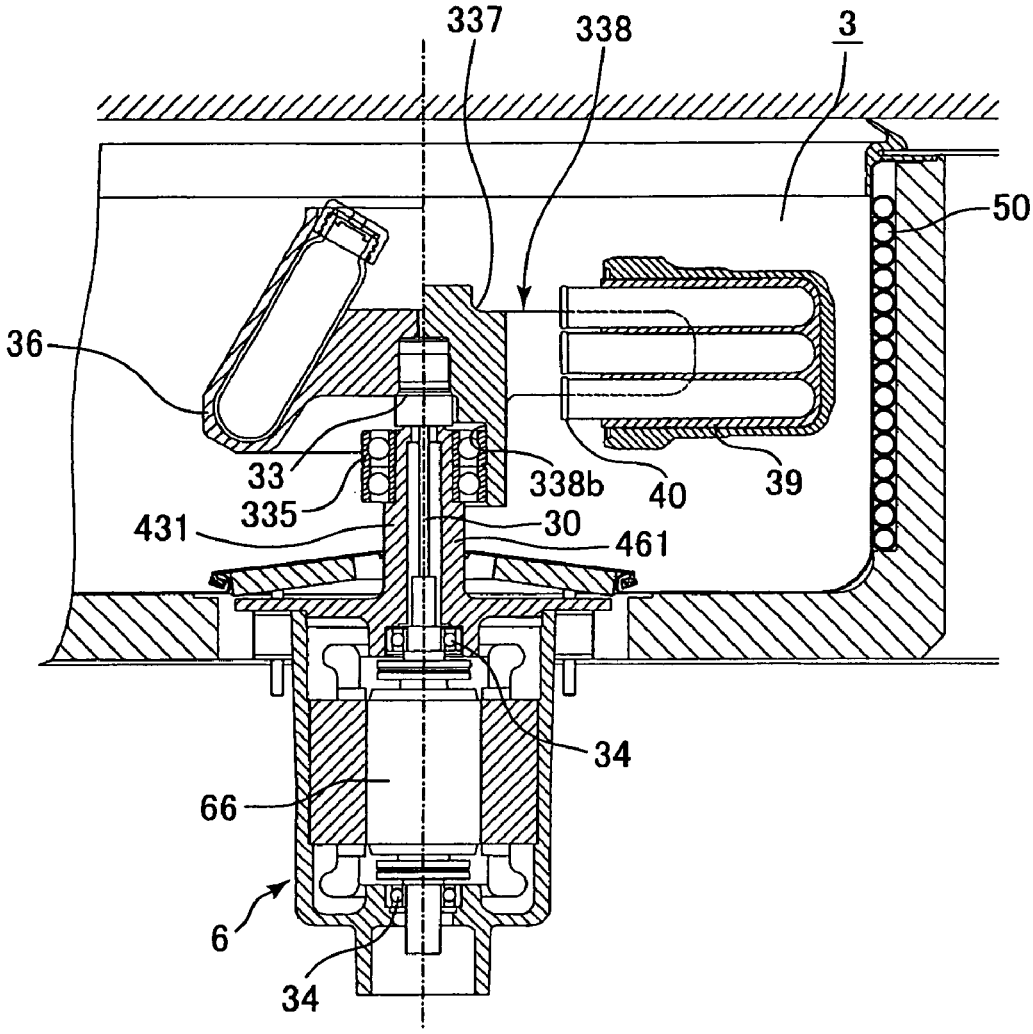
FIG. 15 is a cross-sectional view of a drive unit in a centrifugal separator according to a third modification.

A centrifugal separator according to a third modification will be described with reference to FIG. 15. In the embodiment and modifications described above, each of the high-rigidity shafts 31, 231, and 331 is a rotation shaft. However, in the third modification, a high-rigidity shaft as a support shaft is a fixed (unrotatable) shaft 431. A bearing support portion of an end bracket 461 is used directly as the fixed shaft 431. An outer peripheral surface of the fixed shaft 431 in an upper end side forms a reduced outer diameter portion, and two bearings 335 are assembled to the reduced outer diameter portion. Further, an inner peripheral surface of a concave portion 338b in a coupling portion 337 of a swing rotor 338 is engagable with an outer race of the bearings 335, so that the swing rotor 338 is rotatable about the bearing support portion (fixed shaft) 431 via the bearings 335.

In addition, the motor serving as the power generator is not limited to the induction motor but various motors are available, e.g., an electric motor such as a DC motor, and a fluid-operated motor such as an air turbine and an oil turbine as long as rotation torque can be obtained.

Further, rotors are not limited to those shown in the foregoing embodiment and modifications but various rotors are available as long as those rotors have shapes which fit into the crown portion or the tapered portion.

What is claimed is:

1. A centrifugal separator for selectively mounting and rotating a rotor among a plurality of rotors each having a kind or a size different from each other, comprising:

a main body having a rotor chamber that accommodates the selected rotor;

a power generator supported by the main body and having an output shaft which generates rotation torque;

a plurality of shafts extending in the rotor chamber and disposed concentrically; and a storing unit that stores data indicative of operation records for each of the plurality of shafts.

2. The centrifugal separator as claimed in claim 1, wherein the plurality of rotors includes a first rotor and a second rotor; and wherein the plurality of shafts includes:

a rotation drive shaft that drivingly connects the output shaft to the selected first rotor to transmit the rotation torque to the first rotor; and a support shaft that supports the selected second rotor.

3. The centrifugal separator as claimed in claim 2, wherein the support shaft is rotatable by the rotation of the rotation drive shaft via the selected second rotor.

4. The centrifugal separator as claimed in claim 2, wherein the support shaft is rotatable through direct connection to the output shaft.

5. The centrifugal separator as claimed in claim 2, wherein the support shaft is unrotatably extending with providing a bearing to the support shaft.

6. The centrifugal separator as claimed in claim 2, wherein the rotation drive shaft is an elastic shaft and the support shaft is a high-rigidity shaft.

7. The centrifugal separator as claimed in claim 1, further comprising a display unit that displays the operation records stored in the storing unit.

8. The centrifugal separator as claimed in claim 1, wherein the operation records include at least one of accumulated operating time and accumulated number of operations.

9. The centrifugal separator as claimed in claim 8, wherein the operation records includes both the accumulated operating time and the accumulated number of operations, further comprising:

a display unit that displays the operation records stored in the storing unit; and a switch for switching a content on the display unit between the accumulated operating time and the accumulated number of operations.

10. The centrifugal separator as claimed in claim 1, further comprising an outputting unit that outputs the operation records stored in the storing unit to an external device.

11. The centrifugal separator as claimed in claim 1, further comprising a door disposed at the main body and capable of opening and closing to expose the rotor chamber.

12. The centrifugal separator as claimed in claim 1, further comprising a rotor detector that detects a type of the mounted rotor.

13. The centrifugal separator as claimed in claim 1, further comprising a determination unit that determines which shaft the selected rotor employs.

14. The centrifugal separator as claimed in claim 1, wherein the storing unit includes a first memory and a second memory, the second memory being nonvolatile and having an electrical reading and writing capacity, thereby retaining the data even when a power source to the centrifugal separator is shut off.

15. The centrifugal separator as claimed in claim 14, further comprising a battery connected to the first memory for preserving the data stored in the first memory when a power source to the centrifugal separator is shut off.

* * * * *